United States Patent [19]

Yeager

[11] Patent Number: 4,649,693

[45] Date of Patent: Mar. 17, 1987

[54] WRAPPING APPARATUS

[76] Inventor: David B. Yeager, 1345 Valley St., Chaska, Minn. 55318

[21] Appl. No.: 853,628

[22] Filed: Apr. 18, 1986

[51] Int. Cl.[4] ..... B65B 67/10; B65B 41/12; B65B 11/04

[52] U.S. Cl. ..... 53/219; 53/389; 53/390; 242/75.4; 242/156

[58] Field of Search ..... 53/219, 390, 389; 242/75.4, 156, 84.5, 55.2, 55.3

[56] References Cited

U.S. PATENT DOCUMENTS

| | | | |
|---|---|---|---|
| 3,452,511 | 7/1969 | Hoffler | 53/219 |
| 3,850,379 | 11/1974 | Stern | 242/75.4 X |
| 4,099,601 | 7/1978 | Pittman | 242/75.4 X |
| 4,116,749 | 9/1978 | Dufort et al. | 242/75.4 X |
| 4,248,392 | 2/1981 | Parry | 53/390 X |
| 4,336,911 | 6/1982 | Fairchild | 242/156 X |
| 4,477,037 | 10/1984 | Goldstein | 53/390 X |
| 4,522,348 | 6/1985 | Strout et al. | 242/75.4 X |
| 4,551,962 | 11/1985 | Kawahara | 53/389 X |

*Primary Examiner*—Horace M. Culver

*Attorney, Agent, or Firm*—Clayton R. Johnson

[57] ABSTRACT

Apparatus for use in hand wrapping articles, for example trays of meat, with thermoplastic wrapping sheet material (plastic film ) that includes a frame which mounts a wrapping platform, a heated device for severing the wrapping material, a heat sealing platform for sealing the wrapped article, a pair of spaced parallel rollers for supporting a roller of wrapping material with the web of the material extending away from the roll (free end portion) reversely bent over one of the rollers, bracket mechanism for mounting the rollers on the frame, mechanism for selectively varying the pulling force required to pull material from the roll and guide mechanism for abutting against the web intermediate the pair of rollers and the wrapping platform. Also there is disclosed prior art mechanism that includes a threaded shaft extended through the core of a roll of plastic film, a pair of notched bars mounted on the frame for removably mounting each end portion of the shaft and a pair of retainer members threaded on the shaft for abutting against opposite ends of the roll on the shaft.

17 Claims, 7 Drawing Figures

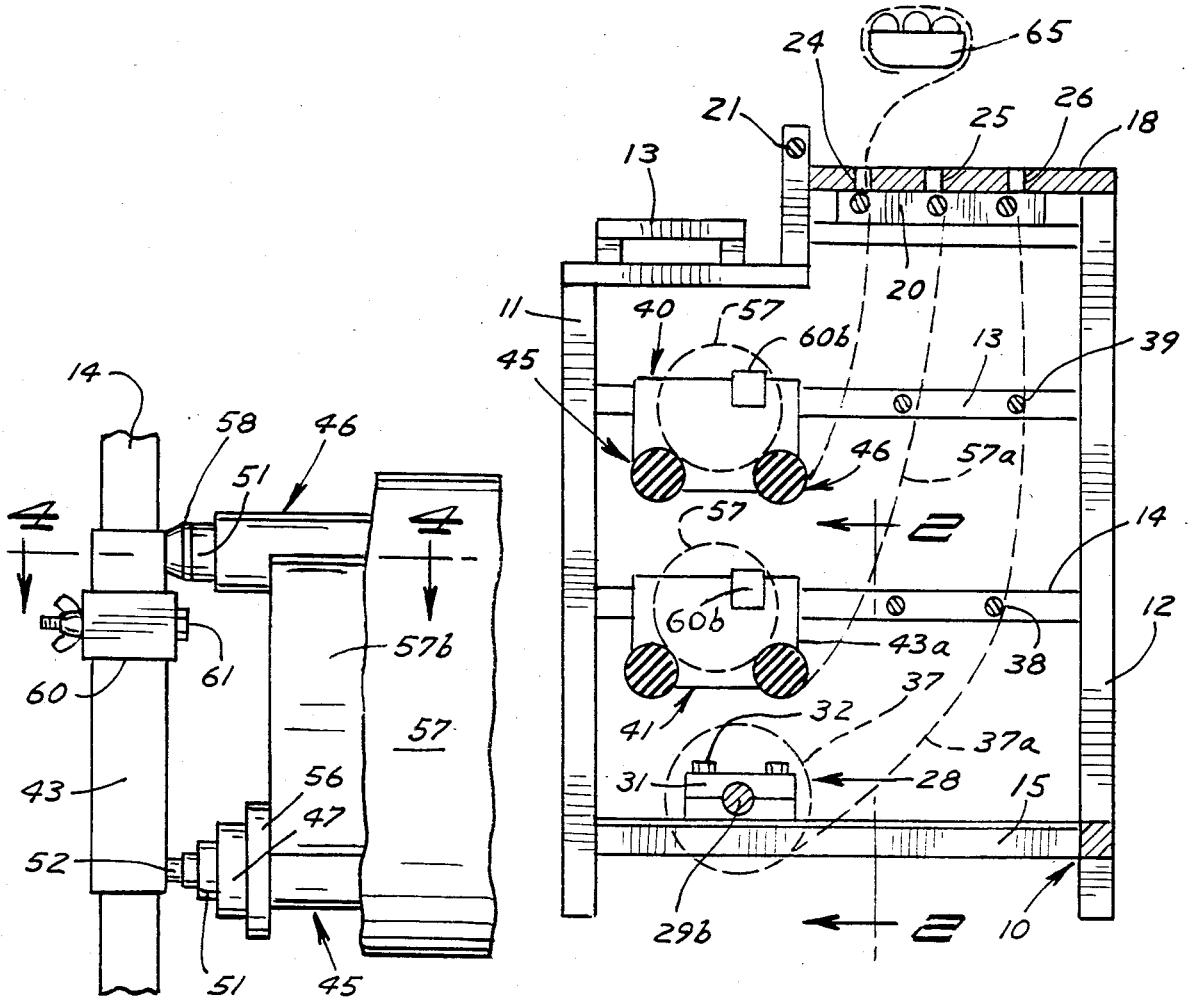
FIG. 3
FIG. 1
FIG. 5
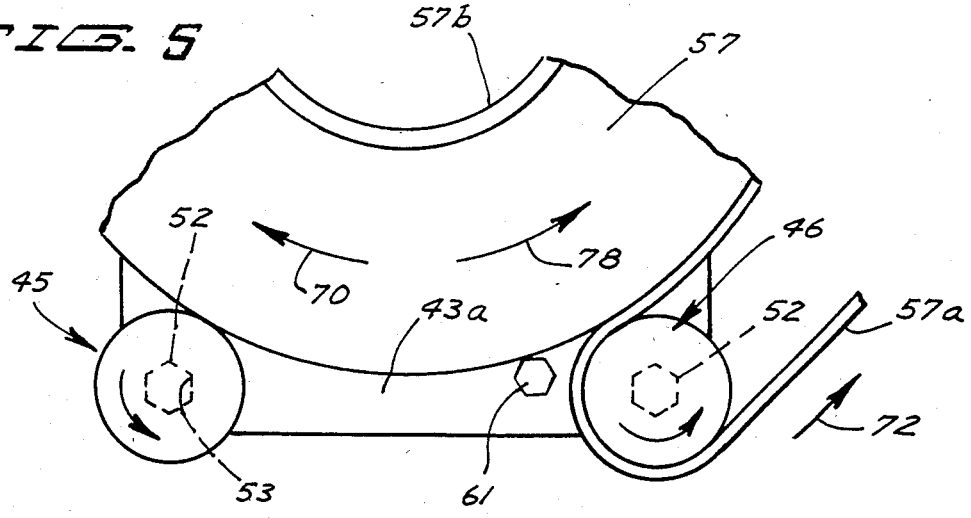

FIG. 2
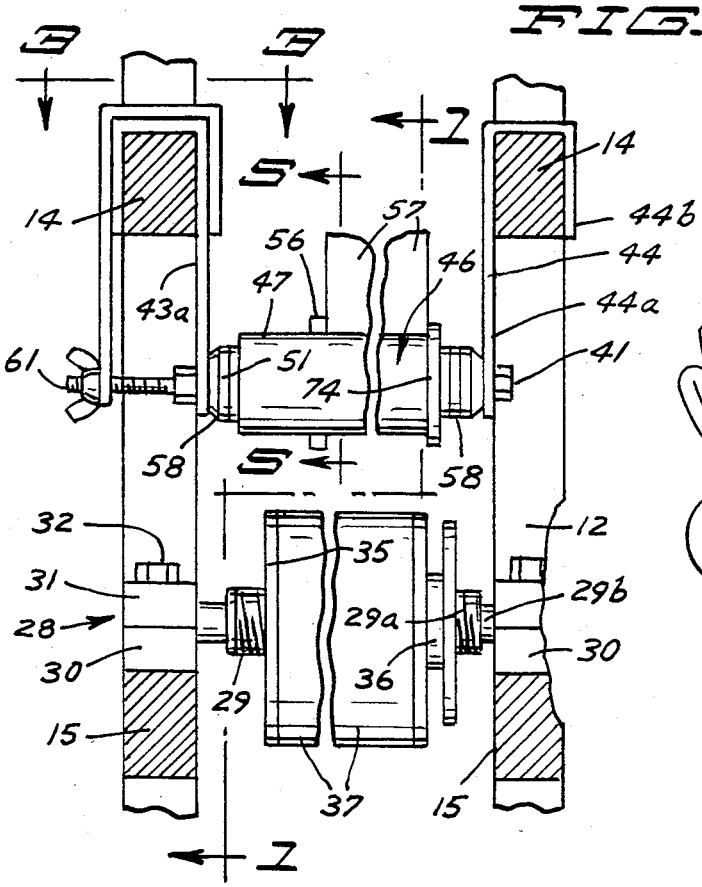
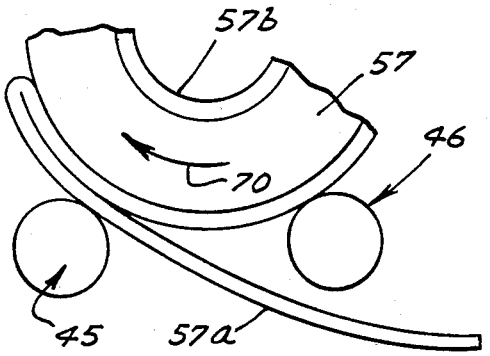
FIG. 7
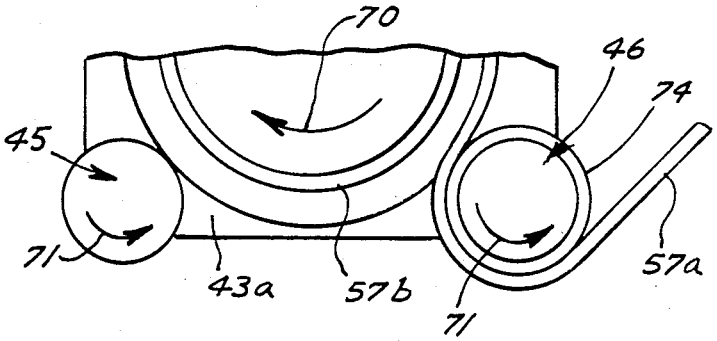
FIG. 6
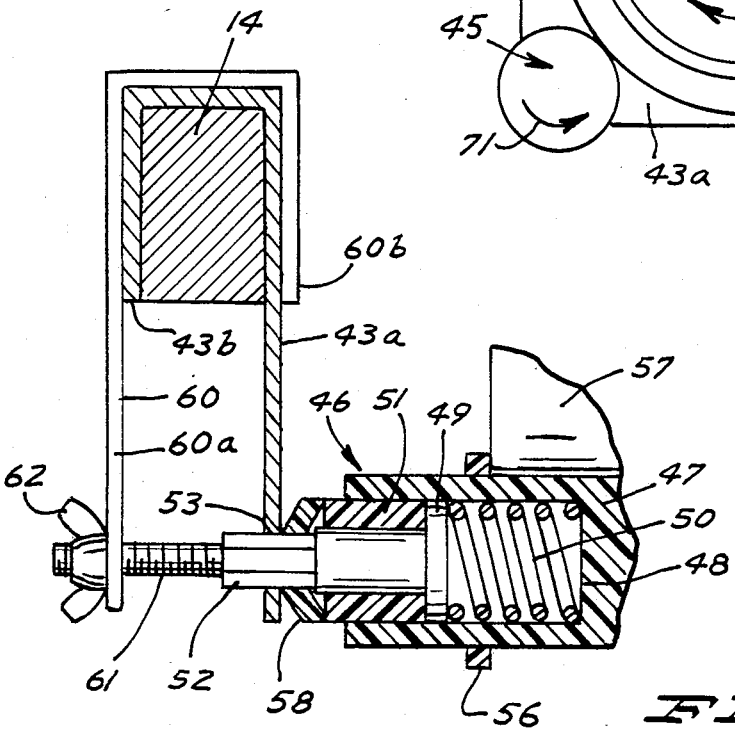
FIG. 4

WRAPPING APPARATUS

BACKGROUND OF THE INVENTION

Apparatus for supporting rolls of thermoplastic wrappring material and providing a wrapping platform for supporting articles to be wrapped, a heat sealing platform and a heated severing rod.

In the prior art it is old to provide a pair of spaced parallel rollers for supporting a roll of sheet material wherein the web is is at least partially reversely bent over one of the supporting rollers, for example see U.S. Pat. Nos. 3,452,511 and 4,141,516 to Hoffles and Olson respectively. However the apparatus for controlling the length of web material dispensed is relatively complex and is not of a construction that is relatively inexpensive and easily installed on previously purchased machines for converting such machines from the type that a shaft or roller is extended through the core of the roll to one wherein the roll of wrapping material is supported by a pair of spaced rollers.

U.S. Pat. No. 3,800,499 to Feldman discloses a packing machine having a wrapping platform, a heat sealing platform, a heated severing wire and a pair of spaced parallel rollers for supporting a roll of thermoplastic film. However there is no mechanism for impeding or stopping the unwinding movement of the roll after the pulling force exerted on the transverse terminal end part of the web has been discontinued to prevent excessive unwinding of the web from the roll.

Further it is old to removably mount the opposite end portions of a shaft on a frame wherein the shaft is extended through the roll. However to replace a roll on the shaft requires disassembling the shaft from it mounting mechanism and thus more time consuming than desirable.

In order to overcome problems such as the above, as well as others, this invention has been made.

SUMMARY OF THE INVENTION

Wrapping apparatus for use in hand wrapping articles that includes a frame having a first and a second horizontal frame member that are parallel to one another, a wrapping platform, a heat sealing platform and a heated servering member mounted on the frame, a pair of rollers that each has a first and a second end portion, and a first and a second bracket removably mounted on the first and second frame member for mounting the first and second end portions respectively of the rollers so that the rollers extend parallel to one another to rotatably support a roll of heat severable sheet wrapping material with the free end portion of the material reversely bent over one of the rollers and extended from the last mentioned roller toward the wrapping platform. Preferrably there is provided selectively adjustable tension varying mechanism acting between one of the brackets and one of the rollers to vary the pulling force required to be exerted on the web to cause rotation of the web.

One of the objects of this invention is to provide new and novel means for converting a wrapping machine from a type that a roll of wrapping material is supported by a shaft extended through the core of the roll to a type the roll is rotatably supported by a pair of parallel rollers. In furtherance of the above mentioned object, it is another object of this invention to provide new and novel means for cooperating with one of the parallel rollers to selectively vary the pulling force required to be exerted on the wrapping material to result in unwinding rotational movement of the roll. Another object of this invention is to provide on a wrapping machine for hand wrapping articles, new and novel means for supporting a roll of wrapping material and varying the pulling force required to be exerted on the wrapping material web to unwind the wrapping material from the roll.

BRIEF DESCRIPTION OF THE DRAWINGS

FIG. 1 is a semidiagrammatic cross sectional view of a conventional wrapping machine that incorporates the present invention, said view being generally taken along the line and in the direction of the arrows 1—1 of FIG. 2 and showing rolls of wrapping material in phantom;

FIG. 2 is a fragmentary vertical, transverse cross sectional view that is generally taken along the line and in the direction of the arrows 2—2 of FIG. 1 with a transverse intermediate portion broken away, said view showing prior art wrapping material roll supporting below the wrapping roll this invention;

FIG. 3 is a fragmentary plan view of the wrapping material roll mounting mechanism of the present invention, said view being generally taken along the line and in the direction of the arrows 3—3 of FIG. 2;

FIG. 4 is a fragmentary vertical transverse cross sectional view generally taken along the line and in the direction of the arrows 4—4 of FIG. 3;

FIG. 5 is an enlarged fragmentary view generally taken along the line and in the direction of the arrows 5—5 of FIG. 2, the showing of the thickness of the reversely bent web protion being exaggerated and the rollers not being shown in cross section to facilitate the showing of the shape of the roller end portions and the openings in the bracket through which the end portions are extended;

FIG. 6 is a view corresponding to FIG. 5 other than a rubber ring is move along one roller to be under the wrapping material roll to offset the decreased friction between the roll and roller; and FIG. 7 is a fragmentary diagrammatic showing of a condition that can occur when there is insufficient resistance to the unwinding rotation of the roll when the free terminal end portion of the roll is pulled.

Referring to FIG. 1 there is shown prior art wrapping apparatus for supporting three rolls of wrapping material with two of prior art roll supporting assemblies being replaced with the roll supporting assemblies, generally designated 40, 41, of the present invention, the apparatus being used for hand wrapping articles. The apparatus includes a frame, generally designated 10, having front legs 11, rear legs 12, upper, intermediate and lower longitudinal horizontal frame members 13, 14, 15 respectively that are rectangular in transverse cross section, are parallel to one another and are joined to the front and rear legs on the respective side of the frame. An electric heat sealing platform 17 is mounted on the upper front portion of the frame, a wrapping platform (lid) 18 is hingedly mounted on the rear upper portion of the frame (the hinge mounting mechanism not being shown as it does not form a part of the invention and the invention can be used without the wrapping platform being hingedly mounted) and an electric heat severing rod or wire 21 mounted on the frame longitudinally intermediate the platforms. The wrapping platform has three transverse slots 24 25, 26 extending vertically therethrough. A rack 20 is mounted on the frame beneath the lid and includes three parallel rods, the rack being mounted for adjustable fore and aft movement by structure (not shown) that does not form a part of this invention.

The prior art wrapping material roll supporting assembly, generally designated 28, includes an axially elongated transverse shaft 29 having an intermediate threaded portion 29*a* and opposite reduced diameter end portions 29*b*. A bar 30 having an upwardly opening notch is fixedly mounted on each of the frame member 15 to extend thereabove. The ends of the shaft 29 are positioned in the notches of bars 30 and then bars 31 are positioned on bars 30 to have the shaft opposite end portions extend into the downwardly opening notches of bars 31. A pair of cap screws or bolts 32 are extended through apertures in each bar 31 and are threaded into the adjacent bar 30 in a convention manner to clamp the adjacent shaft end portion therebetween. An internally threaded retainer 35 is threaded on the shaft to limit axial movement of the roll of wrapping material 37 that has the shaft extending through the core thereof moving in one transvers direction while an internally threaded retainer 36 is threaded on the shaft to limit movement of the roll in the opposite axial direction. The web (free end portion) 37*a* that is unwound from the roll 37 extends upwardly and adjacent to the transverse guide rods 38, 39 mounted by frame members 14 and 13 respectively and up to the rear rack rod to be pulled through the wrapping platform slot 26.

Frame members 13 mount the wrapping roll support assembly, generally 40, of this invention, while frame members 14 mount the roll support assembly, generally designated 41, that is of the same construction as assembly 40. The assemblies 40, 41 have been mounted on frame in place of assemblies 28 that were originally provide as part of the prior art machine. The assembly 28 shown on frame members 15 has been shown in place of an assembly of the present invention in order to facilitate an understanding of the advantages of the present invention.

The assembly 41 includes a pair of brackets 43, 44 that are generally J-shaped in transverse cross section and have web portions abutting against the top surfaces of frame members 14 and their long legs 43*a*, 44*a* more closely adjacent one another than their short legs 43*b*, 44*b*. The long legs depend to a substantially lower elevation than the bottom surfaces of frame members 14.

The brackets 43, 44 mount a front and a rear axially elongated roller, generally designated 45, 46 respectively in horizontally spaced, parallel relationship. Each roller has an axially elongated roller member 47, 51 that includes a roller element 47. Each of the roller elements advantageously are made of plastic and may have a relatively smooth outer circumferential surface. A bore 48 is provided in each end portion of each roller element. A plunger axially slideably extends into each bore has an enlarged diametric end portion 49 within the bore that abuts against a coil spring 50 provided within the bore for resiliently urging the plunger axially outwardly, an intermediate diameter plunger portion having one end joined to portion 49 and axially slidably extended through an annular retainer 51, and a hex shaped end portion 52 that is extendable through a hex shaped aperture 53 in the respective lower corner portion of the respective leg 43*a*, 44*a*. The retainer 51 extends within bore 48 and has one end portion abuttable against the plunger portion 49 to limit the axial movement in one axial direction while the coil spring in abutting against the closed end of the bore limits the movement of the plunger in the opposite axial direction. The retainer is joined to the wall portion of the roller element that in part defines bore 48 and extends axially outwardly of the bore, retainer 51 being joined to the roller element 47 to be in fixed relationship thereto and form a part of the roller member.

An annular rubber gasket (retainer member) 56 is provided on the roller member of roller 45 to form a friction fit therewith to be manually slid to various axial positions for abutting against one end of roll 57 for limitting the axial movement of the roll on the rollers 45, 46 in one axial direction. Due to the rollers not being perfectly horizontal, for example due to the floor on which the machine is located not being level, during use the roll would move in one axial direction or the other if it were not for the gasket preventing such movement.

One or more annular rubber gaskets (friction members) 58 is provided on the hex end portion of each of the plungers of the roller 46 to be located between the plunger intermediate diameter portion and the adjacent bracket leg 43*a*, 44*a* respectively and form a friction fit with the hex end portion to be non-rotatable relative to the hex end portion during use. The gaskets 58 are of outer diameters about the same as retainer 51 whereby the adjacent face of the adjacent gasket will bear thereagainst. During use when the plungers of roller 46 are in or adjacent their datum positions the gaskets assume a generally frusto conical condition due to the hex portions extending further axially away from the roller member than the plunger intermediate portions which are of a greater diameter than the perpendicular distance between parallel surfaces of the hex end portion, and the adjacent bracket leg abutting against or being closely adjacent to the face of the gasket. As may be noted in FIG. 4, during normal use the inner peripheral portion of the gasket is more axially remote from the plunger portion 49 than its outer peripheral portion. Advantageously the gaskets are rectangular in axial cross section through an arcuate portion thereof.

The bracket apertures 53 and hex portions of the plungers are of shapes to prevent rotation of the plungers relative to the legs 43*a*, 44*a*, but still permit the plungers being moved axially from their datum positions a sufficient distance into the roller members for removing the rollers from the brackets. With reference thereto the friction members can slide along the hex portions 52 to permit the plungers being moved against the urging of the springs 50.

Even though the drawings indicate that the bores 48 extend a relatively short axial distance into the roller element, it is to be understood that advantageously the bore may extend axially through the roller element, that each of the plunger intermediate diameter portions and retainers 51 may be of axial lengths greater than ¼ of the axial length of the roller element wherey the plunger portions 49 are located much more closely axially adjacent to one another and that only one spring 50 be provided so that one end bears against end portion 49 of one of the plungers and the opposite end against the end portion 49 of the other plunger. In such an event a single spring constantly resiliently urges the plungers away from one another and bearing surfaces of the plungers and roller retainers that are rotatable relative to one are of greater axial lengths than with bores 48. Accordingly less binding type frictional engagement occurs between the plungers and the roller members than when the bearing surfaces are of shorter axial lengths such as with the structure as shown in FIG. 4.

Normally the friction members 58 or the outermost friction member if more than one is provided on a plunger member abuts against the adjacent legs 43*a*, 44*a* to resist rotation of the rear roller member. However to permit adjusting the torque required to rotate the roller member of roller 46 relative to its plungers there is providede a generally J-shaped adjustment member 60 that is mounted on bracket 43 to have its web portion extend over and abut against the web portion of bracket 43 and a long leg 60*a* that normally (in a relaxed condition) extends parallel to leg 43*a* and is about the same length. A bolt 61 slidably extends through an aperture provided in the lower part of leg 43*a* to have its head abut against the surface of leg 43*a* that is remote from leg 60*a*. The threaded end of the bolt slidably extends through an aperture provided in the lower end of leg 60*a*, a wing nut 62 being threaded on the bolt to abut against the surface of leg 60*a* opposite leg 43*a*. The adjustment member is of a sufficiently heavier guage metal than leg 43*a* or of a construction such that as the wing nut is further threaded on the bolt with the head and nut abutting against legs 43*a*, 60*a* respectively the lower rear corner portion of leg 43*a* is moved to be more remote from the lower rear corner portion of bracket 44 (i.e. resiliently bends toward the lower portion of leg 60). With reference thereto it is to be noted the aperture in leg 43*a* through which the bolt extends is many times closer to the aperture 53 through which the plunger of roller 46 extends than the aperture through which the plunger of roller 45 extends. Also with reference to the adjustment feature, it is noted frame members 13, 14 in transverse cross section are rectangular, the spacing of legs 43*a*, 43*b* in their non-stressed condition forming a close fit with the adjacent vertical surfaces of the frame members and extending parallel thereto, and the adjacent surfaces of legs 60*a*, 60*b* of member 60 in their non-stressed condition forming a close fit with the adjacent surfaces of legs 43*a*, 43*b* respectively and extending parallel thereto.

In use the rolls of material on the roll support assemblies may be of different axial widths. In using roller assembly 40, a roll of thermoplastic film material 57 is positioned on rollers 45, 46 with gasket 56 abutting against the appropriate end of the roll and the free terminal edge part of the roll is pulled so that the free end portion 57*a* reversely extends partially around roller 46, thence upwardly to be abuttable against the rear surface of the front rod of the rack and then upwardly through slot 24. The terminal transverse end portion of the film is pulled so that the roll is unwound and the tray (article) 65 manually rotated and/or the web pulled to extend around the tray to completely wrap the tray. Now the wrapped tray is moved moved forward and downward such that the portion of the free end portion that is rearwardly adjacent to the tray is moved into engagement with the heated wire 21 to server the web. Thereafter the severed edge portion of the wrapped web is wrapped around the tray to be beneath the tray and the wrapped tray moved into engagement with the sealing platform in a conventional manner.

As the free end portion 57*a* of roll 57 is pulled the film (unless most of the film has been removed from the roll core 57*b*) is in sufficient frictional engagement with roller 46 to cause its roller member to rotate in the direction of arrow 71 while the pulling force results in the roll rotating in the direction of arrow 70 about the central axis of core 57*b*. This rotation of the roll also causes the roller member of roller 45 to rotate in the direction of arrow 71 about its central axis.

When a new roll is placed on the rollers 45, 46 it is relatively heavy and thus as the web is pulled, the roll does not tend to continue to rotate more than necessary for the length of web pulled through the slot. Also the weight of the roll results in their being sufficient frictional contact between the roll and roller members that relative rotation takes place such as described in the preceeding paragraph. As a result at this time the wing nut is sufficiently threaded on bolt 61 to pull the lower portion of leg 43*a* toward leg a distance that legs 43*a*, 44*a* are out of, or in very loose abutting relationship with the adjacent friction member. Accordingly the friction members 58 provide little, if any frictional resistance to the rotation of the roller member of roller 46. As web material is used up the roll becomes lighter and when the terminal free end portion is pulled the roll may continue to rotate in an unwinding direction angularly through a dimension greater than the length pull through the wrapping platform slot whereby more sheet material than needed is unwound from the roll. Some of the time this excess unwinding rotation results in the reversely bent portion of the web moving away from roller 46 in the direction of arrow 70 to pass between roller 45 and the remainder of the roll such as schematically shown in FIG. 7. This is undesireable in that in subsequent pulling the terminal end portion the film may tear, or the pulling first tends to rotate the roll in the direction of arrow 73 to pull the unwound web portion from between the roll and roller 45, or the roll is manually rewound or otherwise manually manipulated so the unwound web portion is no longer extending between the roll and roller 45.

To avoid the occurrence (or reoccurrence) of the condition shown in FIG. 7, the wing nut is turned in an unthreading direction whereby the lower end portion of leg 43*a* resiliently moves away from the corresponding part of leg 60*a*. This results in the gaskets 58 on roller 46 being compressed to impose a greater frictional resitance to the rotation of the roller member against which they abut (greater torque required to rotate the roller member). This decreases the tendency for excessive unwinding movement of the roll.

At the time the movement of film on the roll gets low, due to the decrease in weight, there is very little frictional resistance to the web sliding over the roller member of roller 46 and the film may slide around the roller member of roller 46 rather than causing it to rotate as the free terminal end portion of the web is pulled. To avoid this the rubber ring member 74 is slid along the roller member 47 of roller 46 to be beneath the end portion of the roll that is axially opposite the retainer 56. This increases the frictional contact such that the roller member rotates as the free terminal end portion is pulled. Of course if the outer peripheral surface of the roller member of roller 46 were rubber coated, such sliding (slippage) would not occur until substantially all of the film was removed from the core.

When there is no more film on the core, the core is merely lifted off of the rollers 45, 46, the friction member 74 is moved axially so as not to be beneath the new roll, the new roll placed on rollers 45, 46 and the wing nut 62 adjustably threaded, if necessary, for proper operation. This may be accomplished much more quickly than can be accomplished when using roll support assembly 28. That is when a new roll 37 is to be placed on shaft 29 all four bolts 32 have to be removed, the shaft 29 lifted out of the notches of bars 30, retainer 36 unthreaded from the shaft, the core of the used roll 37 removed and the procedure reversed to mount the new roll 37.

Additionally if the wing nut is properly threaded fcr the required friction adjustment, a sudden jerk on the free terminal end portion of the web is much less likely to cause film to be unwound sufficiently to hang a substantial distance downwardly from the normal path of movement of the free end portion, this being in contrast to using the roller assembly 28.

Not previously mentioned is that the horizontal spacing of the most closely adjacent parts of the roller members of rollers 45, 46 is less than the outer diameter of the core 57*b*.

To be noted no tools are required for mounting the roller assemlies of this invention on prior art wrapping machines having a pair of transversely spaced parallel horizontal frame members, for selectively varing the tension required to rotate the roller member around which the free end portion of the film is looped, or for replacing one roll with another.

When the wing nut is sufficiently loosely threaded on bolt 61 there is no bending stress imparted therethrough to leg 43*a*, the legs 43*a*, 44*a* exert the maximum compressive force to the friction members 58, and the maximum torque required to rotate the roller member of roller for a given weight of the roll on the rollers 45, 46. If this does not sufficiently increase the torque requirements for rotating the roller member of roller 46 another friction member 58 (or one of greater thickness than the one being used) may be mounted on one of the plungers of roller 46. The leg 43*a* is sufficiently bendable by tightening (threading) the wing nut that the legs 43*a*, 44*a* exert very little or no compressive force to the friction members 58.

To be mentioned is that the bracket 60 may be of a shape to be directly mounted on a frame member, for example the long leg of an L-shape with the lower horizontal leg of the L extendding to a position to have the bolt extended therethrough. Further the positions of the long legs of the roller mounting brackets can be more remotely spaced from one another than the short legs if the rollers are of a longer axial length, or the brackets 43, 60 turned on the frame member such that the leg 43*a* is more remotely spaced from the bracket 44 than leg 60*a* with each the rollers being of appropriate lengths. In the latter event to decrease the resistance to rotation of roller member of roller 46, the wing nut would be turned in an unthreading direction.

What is claimed is:

1. Wrapping apparatus for use in hand wrapping articles in the free end portion of material that is unwound from a roll of such material, comprising a frame having an upper end portion and a first and a second horizontal frame member that are transversely spaced from one another, a wrapping platform mounted on the frame upper end portion in vertical spaced relationship to the frame members, a first and a second axially elongated roller member in parallel relationship for cooperatively supporting the roll and having the free end portion of the sheet material from the roll extending in a reversely curved relationship partially around the first roller member and then toward the platform whereby as the free end portion is pulled the roller members and roll will rotate, said roller members each having a first and a second end portion, first means mounted by the first frame member for mounting the roller members first end portions in spaced relationship for rotation relative to one another and second means for mounting the roller members second end portions on the second frame member in the same spaced relationship as the roller members first end portions and for rotation relative one another so that the roller members are mounted in parallel relationship to rotatably support the roll, said first means including a first bracket removably mounted on the first frame member, and means interacting with the bracket and the first roller member for selectively varying the torque required to be imparted by pulling on the free end portion of the sheet material to rotate the first roller member and cause it to continue to rotate as long as said free end portion is being pulled.

2. The apparatus of claim 1 further characterized in that the last mentioned means includes means for frictionally engaging the first roller member as it rotates.

3. The apparatus of claim 1 further characterized in that the second means includes a second bracket removably mounted on the second frame member, that the first and second means include means mounted by the brackets for mounting the roller members for rotation, that the means interacting with the bracket includes means mounted on the means mounted by the brackets for being urged into frictional engagement with one of the roller members to vary the torque required to rotate the last mentioned roller member and adjustment means mounted adjacent to the first bracket for in cooperation therewith varying the force with which the frictional engagement means is urged into frictional engagement with the said last mentioned roller member.

4. The apparatus of claim 3 further characterized in that the first bracket has a first leg having a lower end portion at a substantial lower elevation than the first frame member, that the frictional engagement means is mounted between the first leg lower end portion and the first roller member for being forced by the bracket first leg into abuttable relationship with the first roller member and that the adjustment means is mounted by one of the first frame member and the first bracket and has a leg having a lower end portion, and means interacting between the lower end portions for selectively varying the force exerted by the bracket first leg against the frictional engagement means to vary the force holding the frictional engagement means in engagement with the first roller member.

5. The apparatus of claim 3 further characterized in that the means for rotatably mounting the roller members on the brackets includes spring urged plunger means mounted in the first roller first end portion for supporting the first roller member first end portion for rotary movement relative thereto and resiliently retained in a datum position extending a preselected distance axially outwardly of the first roller member first end portion and a second position located axially more closely adjacent to the first roller second end portion than in its datum position, said plunger means having a first end portion that in the plunger means datum position is located axially outwardly of the first roller member and that the first bracket has an opening therethrough through which the plunger means first end portion is removably extended.

6. The apparatus of claim 5 further characterized in that the bracket means opening and plunger means first end portion are of relative shapes that the first bracket prevents rotation of the plunger means and that the frictional engagement means is mounted on the plunger first end portion in non-rotating relationship thereto between the roller member and the first bracket.

7. The apparatus of claim 6 further characterized in that the first frame member is rectangular in transverse cross section and has a top surface and opposite side surfaces, that the first bracket is is generally J-shaped in transverse cross section and has a short leg abutting against the first frame member side surface that is remote from the second frame member and a long leg that has a lower end portion located a substantial distance below the first frame member and abuts against the first frame member side surface that is adjacent to the second frame member, the first leg lower end portion having the bracket opening.

8. The apparatus of claim 7 further characterized in that the adjustment means includes a generally J-shaped third bracket mountable on the first bracket and having a short leg abutting against the first bracket long leg and a long leg abutting against the first bracket short leg and having a lower end portion at about the same elevation as the first leg lower end portion and means engaging both legs lower end portions for selectively bending the bracket first leg to move the first leg lower end portion toward the third bracket lower end portion.

9. The apparatus of claim 8 further characterized in that the roller members have rigid circumferential surfaces, that there is provided a first resilient annular retainer member on one of the roller members in frictional engagement therewith and axially adjustable relative theretofor limiting axial movement of the roll in one axial diameter relative to the roller members, and an annular rubber member on the first roller member in frictional engagement therewith and axial movable relative thereto for being positionable beneath one end portion of the roll to transmit a turning force to the first roller member as the free end portion of the roll is pulled that the material is a heat sealable plastic film, and that a heat sealing platform and a heated severing rod are mounted by the frame upper end portion.

10. Wrapping apparatus for use in hand wrapping articles in the free end portion of flexible sheet material that is unwound from a roll of such material, comprising a frame having an upper end portion and first and second parallel frame members that are transversely spaced from one another and have top surfaces and opposite side surfaces, a wrapping platform mounted on the frame upper end portion in vertical spaced relationship to the frame members, a first and a second generally J-shaped bracket that each has a long leg and a short leg that are removably positioned on the first and second frame members respectively with the bracket long legs more closely adjacent to one another than their short legs, each leg having a lower end portion locared at a substantially lower elevation than the frame members, a first and a second axially elongated roller in parallel relationship to one another and having first and second end portions mounted by the brackets for supporting the roll with the free end portion partially reversely looped around the first roller, said rollers including rotatable roller members axially between the brackets long legs for supporting the roll for rotation relative therto and that are rotatably relative to one another, each of the bracket lower end portions having a pair of spaced openings for the adjacent end portion of the rollers to extend through, each of the roller first end portions extending into the respective roller member, being axially movable relative thereto between a datum first position extending through the adjacent bracket opening and a second position extending more closely adjacent to the second end portions of the rollers and a second position out of the bracket opening to permit removal of the rollers from the brackets, and spring means within each of the roller members for resiiently retaining the respective first end portion in its datum position while permitting it moving to its second position.

11. The apparatus of claim 10 further characterized in that each of the roller end portions is rotatable relative to the respective roller member and that the roller second end portions extend into the respective roller member, and that the bracket openings and roller first end portions are of relative shapes to block rotation of the first roller end portions when extended into the bracket openings.

12. The apparatus of claim 11 further characterized in that there is provided means on one of the roller end portions in abuttable relationship to the adjacent bracket to frictional engage the roller member of the last mentioned roller and means for selectively adjusting the positions of the lower end portion of the leg of the last mentioned bracket to vary the frictional force between the frictional engagement means and the roller member that it engages.

13. The apparatus of claim 10 further characterized in that there is provided annular resilient means on one of the roller end portions that is in abutting relationship to the axially adjacent roller member and the adjacent bracket, and means mounted by one of the frame members and the last mentioned bracket for adjustably compressing the annual resilient member between the said last mentioned roller member and said last mentioned bracket to adjustably vary the resistance to rotation of the said last mentioned roller member.

14. The apparatus of claim 13 further characterized in that the last mentioned means includes a third bracket mounted on the first bracket and having a leg that has a lower end portion located at a substantially lower elevation than the first frame member, that the long leg of the second bracket is more resilient than the third bracket leg, and means interconnecting the lower end portion of the first bracket long leg and the third bracket leg for adjustably varying the spacing between the last two mentioned lower end portions and thereby the degree of compression of the annular resilient means.

15. The apparatus of claim 14 further characterized in that the above mentioned resilient means is mounted on the first end portion of the first roller and that there is provided annular resilient means on the first roller second end portion in abuttable friction bearing relationship between the first roller member and the second bracket so that as the first mentioned annular resilient means is compressed it also is compressed.

16. For converting a machine for hand wrapping articles in the free end portion of a flexible sheet of material that is unwound from the roll wherein a shaft is extended through the core of the roll and has to be disassembled from first and second transverse frame members of the frame before replacing a roll on the shaft with there being a wrapping platform on the frame, to one wherein the roll can be replaced without any disassembly operation, comprising a first and a second generally J-shaped bracket that are adapted to be removably positioned on the first and second frame members respectively, a first and a second axially elongated roller havng a first end portion and an axially opposite second end portion, each of said rollers including a roller member, at least the first end portion of the rollers extending into the respective roller member and resiliently retained in a datum position extending axially outwardly of the roller member and a second position more closely adjacent to the respective roller second end portion, the bracket having roller receiving opening through which the roller end portions are removably extended for mounting the rollers in parallel relationship to cooperatively supportingly engage the roll outer peripheral surface, the roller members being rotatable relative to the brackets and the roll supported thereby.

17. The apparatus of claim 16 further characterized in that the first bracket has a resiliently bendable portion that has at least one of said openings therein, that there is provided annular rubber means on each of the first roller end portion for frictionally engaging the first roller member and being adapted to frictionally engage the adjacent bracket and adjustment means adapted for resiliently bending said bendable portion of the first bracket to selectively vary the compressive force exerted by the brackets on the rubber means when the brackets are mounted by the frame members and the brackets mount the rollers.

* * * * *